US005791100A

United States Patent [19]

Schieferly et al.

[11] Patent Number: 5,791,100

[45] Date of Patent: Aug. 11, 1998

[54] PLANKING AND METHOD OF USE

[75] Inventors: Stephen B. Schieferly, Saylorsburg; John J. Ferretti, Wind Gap; Alvin M. Nestler, Hellertown, all of Pa.

[73] Assignee: Bethlehem Steel Corporation, Del.

[21] Appl. No.: 874,015

[22] Filed: Jun. 12, 1997

[51] Int. Cl.[6] ..... E04F 15/22

[52] U.S. Cl. ..... 52/177; 52/403.1; 52/480; 52/650.3; 52/731.3; 114/266

[58] Field of Search ..... 52/177, 220.4, 52/220.5, 731.1, 731.3, 732.2, 737.6, 480, 403.1, 650.3, 586.2; 114/266

[56] References Cited

U.S. PATENT DOCUMENTS

| | | | |
|---|---|---|---|
| 799,320 | 9/1905 | Franks . | |
| 1,778,337 | 10/1930 | Pratt . | |
| 2,007,354 | 7/1935 | Vass . | |
| 2,008,557 | 7/1935 | Lambert . | |
| 2,549,442 | 4/1951 | Fischer et al. . | |
| 3,113,434 | 12/1963 | Phillips et al. . | |
| 4,078,515 | 3/1978 | Svirklys | 114/266 |
| 4,201,026 | 5/1980 | Murphy . | |
| 4,580,380 | 4/1986 | Ballard . | |
| 4,947,595 | 8/1990 | Douds et al. . | |
| 5,048,448 | 9/1991 | Yoder | 114/263 |
| 5,351,458 | 10/1994 | Lehe | 52/177 X |
| 5,483,782 | 1/1996 | Hall . | |
| 5,553,427 | 9/1996 | Andres | 52/177 |
| 5,613,339 | 3/1997 | Pollock . | |
| 5,617,689 | 4/1997 | Beane . | |
| 5,623,803 | 4/1997 | Willis . | |
| 5,642,592 | 7/1997 | Andres | 52/177 |

*Primary Examiner*—Christopher Kent
*Assistant Examiner*—Yvonne Horton-Richardson
*Attorney, Agent, or Firm*—Harold I. Masteller, Jr.

[57] ABSTRACT

The invention is directed to metal planking used to construct planar surfaces, such as patio, porch and balcony decks, and interior floors and roofs of structures. The metal planking comprises an elongated strut and a slidable cap that covers the strut after the strut is fastened to support members in the structure. The strut includes a first flange and first web spaced apart from a second flange and second web, and a cord extending between the first web and the second web. The cord provides a surface for fastening the strut to the support members of the structure, and the cord includes at least one corrugation extending in an upward direction to a location adjacent the plane of the first and second strut flanges. The slidable cap includes a first hem extending along one edge of the cap, and a second hem extending along the opposite edge of the cap. The first and second hems include a seam shaped to slidably receive either of the strut flanges so that the slidable cap can be pushed onto the flanges and slipped along a length of the strut to cover the strut after the cord is fastened to the support members.

18 Claims, 7 Drawing Sheets

1
1a
2
3
3a
4
4a
5
5a
6
6a
7
7a
8
9
9a
9b
10
10a
11
11a
12
13
16
G
T
W
D

PLANKING AND METHOD OF USE

BACKGROUND OF THE INVENTION

This invention is directed to a metal planking for use as a construction material, and in particular, it is directed to a metal deck plank comprising a formed strut and slidable cap section, and the method for assembling the metal planking during the construction of structures.

In conventional construction procedures it is customary to provide a plurality of spaced apart support members, called beams, joist or rafters, that are installed on a foundation or bearing wall of a structure. Wood planking or plywood sheets are laid to span across the support members, and the planks or plywood are attached to the support members by nailing, screwing or other suitable means. Such deck construction is shown in U.S. Pat. No. 2,549,442 granted to Fischer, et al. The Fischer patent shows wooden deck planks 36 spanning across and nailed to spaced apart support joists 24.

As the state-of-the-art evolved from wood framing to all metal construction, where the joists and planks comprise either rolled, break formed or extruded metal shapes, it became necessary to devise various fasteners and/or connections to assemble the metal framing. The special fasteners were developed because nailing and/or screwing the metal deck planks directly to the support members was no longer possible due to the complexity of the sections and depth of the shapes. Such special connections and fasteners are expensive to produce, and the complex design of all metal decks, floors and roofs of the past made metal frame construction labor intensive. For example, in U.S. Pat. No. 3,113,434 granted to Phillips, et al., the disclosed roof deck design requires special extruded frame members 20, 21, 22 and 23, as well as special fastener, 38 called clincher angles, to support the decking sheets. In a different patent, granted to Douds, et al., a very complex and expensive fastening system is shown for attaching extruded deck planks to support beams 54.

SUMMARY OF THE INVENTION

It is therefore an object of this invention to provide metal planking suitable for use in constructing a patio, porch or balcony deck.

It is also an object of this invention to provide metal planking that can be used to construct floors and roofs in residential and commercial buildings.

It is also an object of this invention to provide metal planking that is simple to install and does not require special connections or fasteners for assembly.

It is a further object of this invention to provide metal planking having a strut and a slidable cap section to facilitate fastening the metal planking to support members without a need for special connections or fasteners.

It is a still further object of this invention to provide metal planking having section properties that permit spanning support members that are spaced apart at greater than 16 inch centers.

We have discovered that the foregoing objects can be attained with metal planking comprising an elongated strut and a slidable cap that covers the strut after the strut is fastened to support members in a structure. The strut includes a first flange and first web spaced apart from a second flange and second web, and a cord extending between the first web and the second web. The cord provides a surface for fastening the strut to the support members of the structure, and the cord includes at least one corrugation extending in an upward direction to a location adjacent the plane of the first and second strut flanges. The slidable cap includes a first hem extending along one edge of the cap, and a second hem extending along the opposite edge of the cap. The first and second hems include a seam shaped to slidably receive either of the strut flanges so that the slidable cap can be pushed onto the flanges and slipped along a length of the strut to cover the strut after the cord is fastened to the support members.

DETAILED DESCRIPTION OF THE PREFERRED EMBODIMENT

Figures 1, 2, 3, 4, 5:
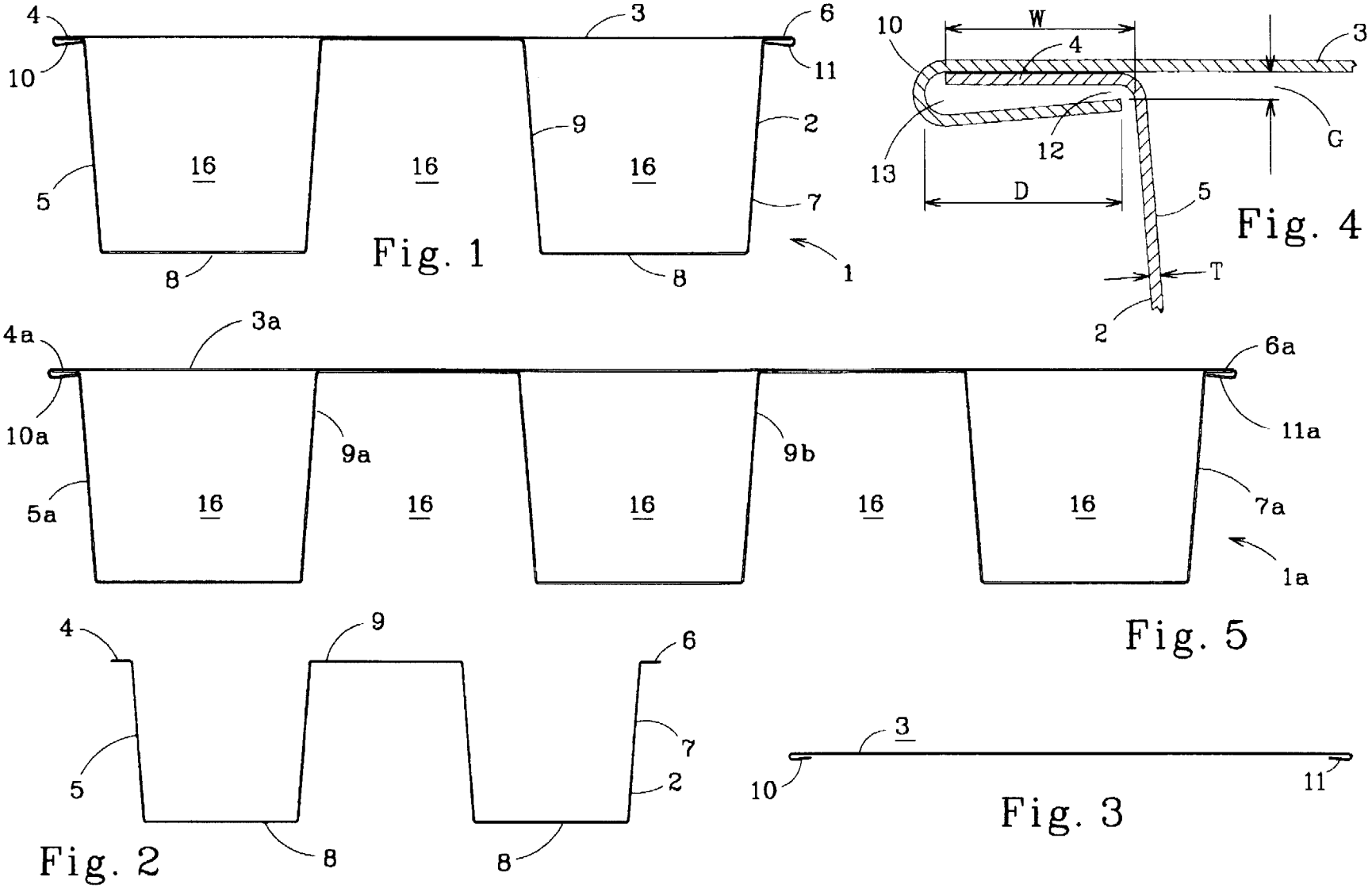
FIG. 1 is an end elevation view of the preferred metal planking.
FIG. 2 is an end elevation view of the strut portion of the preferred metal planking.
FIG. 3 is an end elevation view of the slidable cap portion of the preferred metal planking.
FIG. 4 is an enlarged view showing the interlocking sliding connection used to assemble the metal planking in a deck, floor or roof system.
FIG. 5 is an end view of equivalent metal planking.

Referring to the drawings, FIGS. 1–4 show the preferred embodiment of metal planking for use in the construction of patio, porch or balcony decks, interior floors, and flat roof systems. The metal planking 1 comprises an elongated strut 2 and a slidable cap section 3 that are shipped to the construction site disassembled, and assembled at the construction site to form metal planking 1, after the strut 2 is fastened to support members in the structure under construction.

Figure 6:
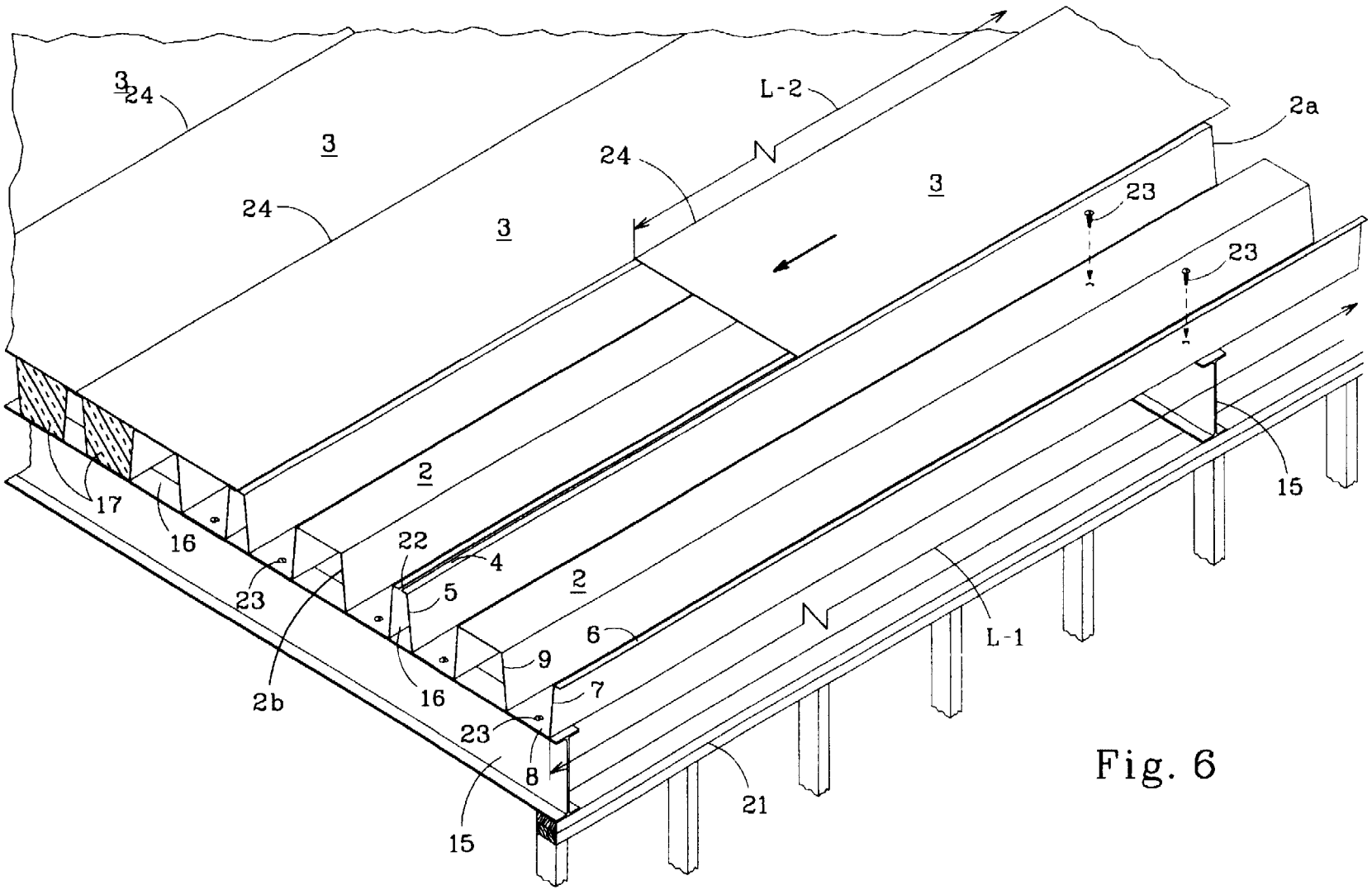
FIG. 6 is an isometric view showing the preferred metal planking as used in a deck, floor or flat roof system.

As more clearly shown in FIGS. 2 and 6, strut 2 comprises an elongated metal section having a length L-1 to fit the dimension of the structure being constructed. The strut includes a first flange 4 and a first web 5 opposite a second flange 6 and a second web 7, and a cord 8 extending between webs 5 and 7. Cord 8 includes at least one corrugation 9 that extends in an upward direction to a location adjacent the plane of the opposed flanges 4 and 6.

Referring to FIGS. 3, 4 and 6 the slidable cap section 3 comprises an elongated metal strip having a length L-2. Length L-2 is substantially equal to length L-1 of strut 2. Cap section 3 includes a first teardrop shaped hem 10 that extends alone of one side of the cap 3, and a second teardrop shaped hem 11 that extends alone the opposite side of cap 3. Both teardrop shaped hems include an opening 12 shaped to receive one of the opposed flanges, either 4 or 6. Each hem 10 and 11 provides an elongated hollow seam 13 that slidably engages one of the strut flanges, either 4 or 6. This provides a slidable connection 14 between the hems and strut flanges so that a cap section 3 can be pushed onto one end 2*a* of a strut fastened to the support members 15. The cap 3 is slipped along length L-1 of the strut 2 toward the opposite strut end 2*b* to cover the strut with cap 3 and form a completed metal plank 1.

In order to provide a sliding fit between the cap 3 and the strut flanges, the hollow seam 13 comprises a seam depth "D" that is greater than the width "W" of the flanges 4 and 6, and gap "G" in opening 12 that is greater than the thickness "T" of the strut 2.

Referring again to FIGS. 1 and 2, the preferred strut 2 includes at least one cord corrugation 9 located between webs 5 and 7. However, it should be understood that any number of cord corrugations can be provided between the webs 5 and 7 without departing from the scope of this invention. For example, in FIG. 5, an equivalent metal plank 1*a* is shown having a first flange 4*a* and first web 5*a* opposite a second flange 6*a* and a second web 7*a*, and a cord 8*a* extending between webs 5*a* and 7*a*. Cord 8*a* has two corrugations 9*a* and 9*b* that extend in an upward direction from the cord to about the plane of the flanges 4*a* and 6*a*. The teardrop hems 10*a* and 11*a* are shown slidably interlocked with flanges 4*a* and 6*a*, and the cap 3*a* is shown positioned to cover strut 2*a* in completed metal planking 1*a*.

As shown in FIGS. 1, 5 and 6, assembled metal planking 1 or 1*a* includes a plurality of cellular channels 16 that are formed by the corrugations 8 and 8*a* and caps 3 and 3*a*. The channels 16 extend longitudinally along the length L-1 of the assembled metal planking. Any one or all of these cellular channels may be filled with an insulation material 17, such as a foam insulation, or left open to provide a passageways 18 for utilities or ventilation as shown located below the caps in FIG. 6.

Figure 8:
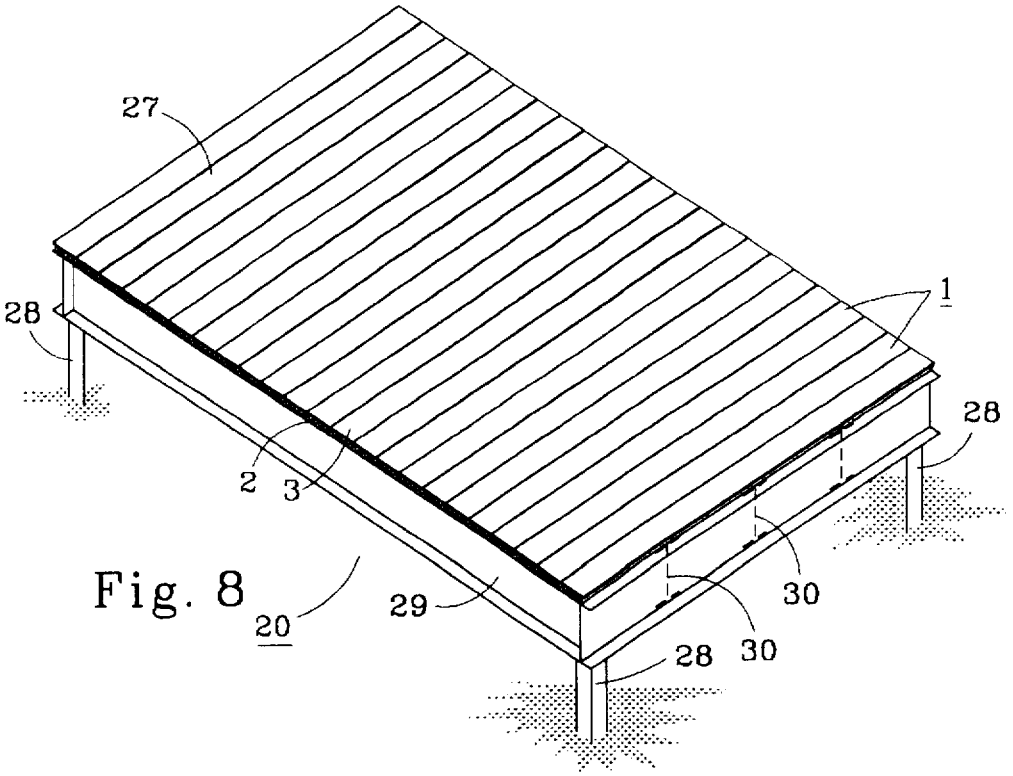
FIG. 8 is an isometric view showing a deck constructed above ground level.
Figure 9:
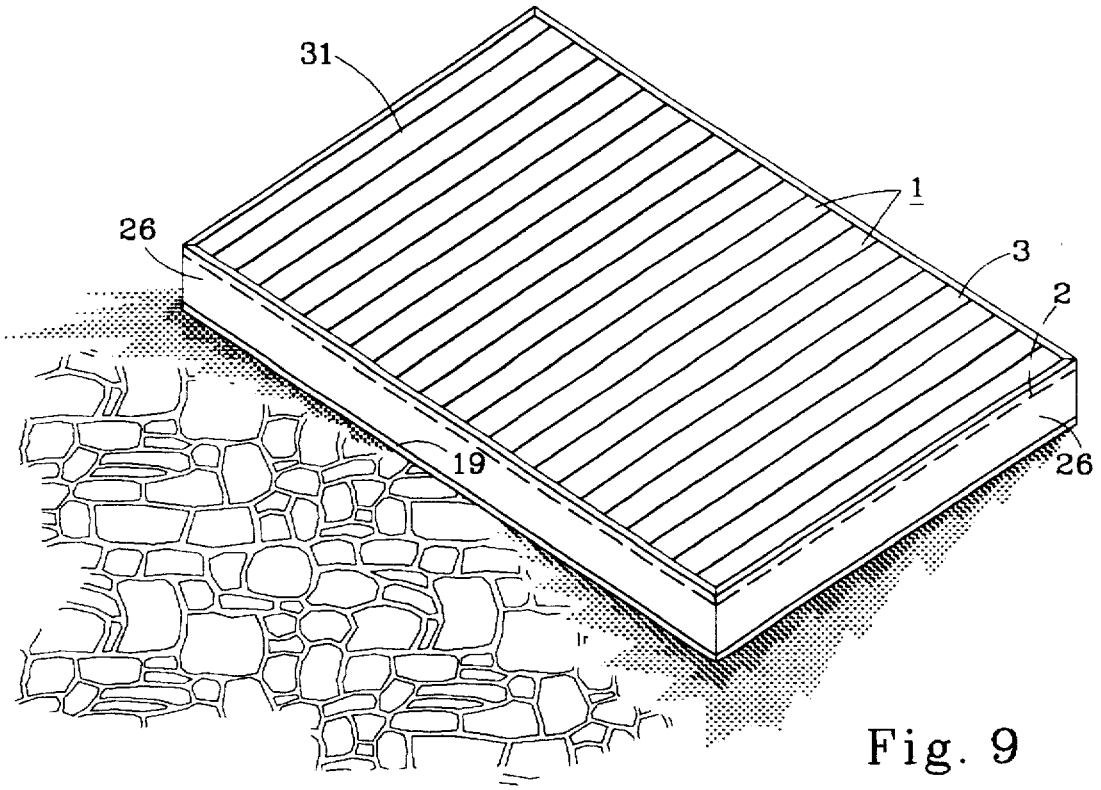
FIG. 9 is an isometric view showing a deck constructed at grade level.
Figure 10:
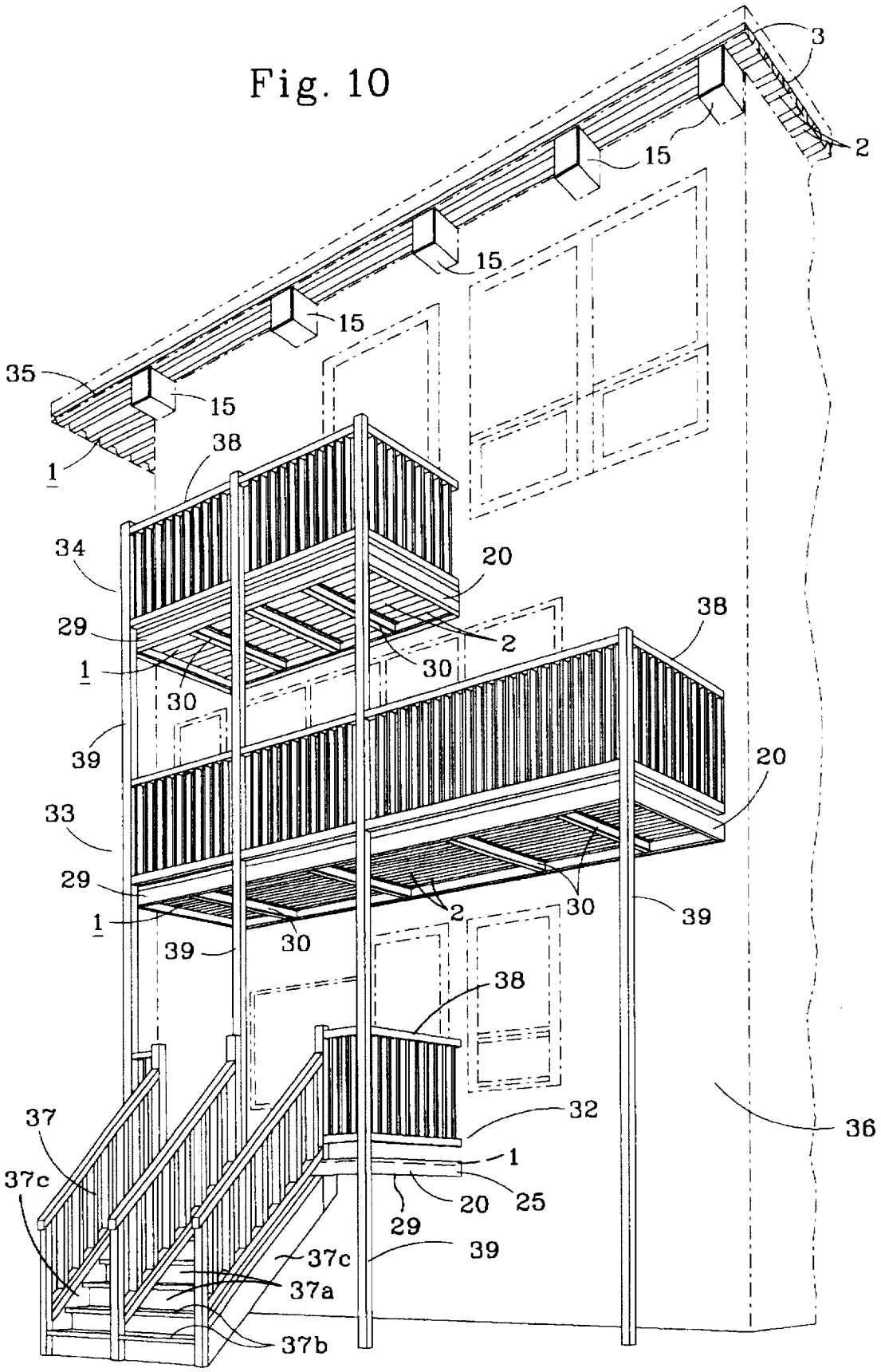
FIG. 10 is a perspective view showing metal planking of the invention used in a multistory building.

To construct either a patio, porch or balcony deck, or an inside floor, or a flat roof, with the metal planking 1 or 1*a*, caps 3 and struts 2 are shipped unassembled to the construction site where the struts 2 attached to the spaced apart support members 15 of the structure under construction with fasteners 23. The support members 15 can be either attached directly to a foundation 19 as shown in FIGS. 7 and 9, supported on an elevated framework 20 as shown in FIGS. 8 and 10, or supported on sill plates or walls 21 as shown in FIG. 6.

The struts are spaced apart along the support members 15 to provide a gap 22 between adjacent struts 2. The gaps provide water drainage when the metal planking 1 or 1*a* is used in exterior construction applications such as patio, porch or balcony decks. The gaps also provide a clearance space for thermal expansion when the metal planking is used for interior applications such as sub flooring. Prior to covering the fastened struts with slidable caps 3 or 3*a*, the cords 8 or 8*a* are accessible for fastening the struts to the support members with fasteners 23, such as self-tapping screws that pierce cord 8 and thread themselves into the support members of the structure. After the struts are fastened to the support members 15, the slidable cap sections 3 or 3*a* are pushed onto the flanges 4 and 6 at end 2*a*, and each cap is slipped along the length L-1 of its corresponding strut toward the opposite strut end 2*b*. As shown in FIG. 6, the struts are spaced apart on support members 15 to provide a gap 22 wide enough to create a smaller gap 24 between adjacent cap sections 3 or 3*a*. This smaller gap 24, when used in outdoor applications as shown in FIG. 8 and 9, permits rain water, or melting snow and ice to drain from the deck system without creating an inconvenience for the users, for example, such as where women's high heel shoe can get caught between the planking. The gaps also provide clearance for thermal expansion in both exterior and interior applications.

It should be understood, however, that although the preferred embodiment shows using a single slidable cap to cover a fastened strut, more than one slidable cap can be used to cover a single strut without departing from the scope of this invention.

Figure 7:
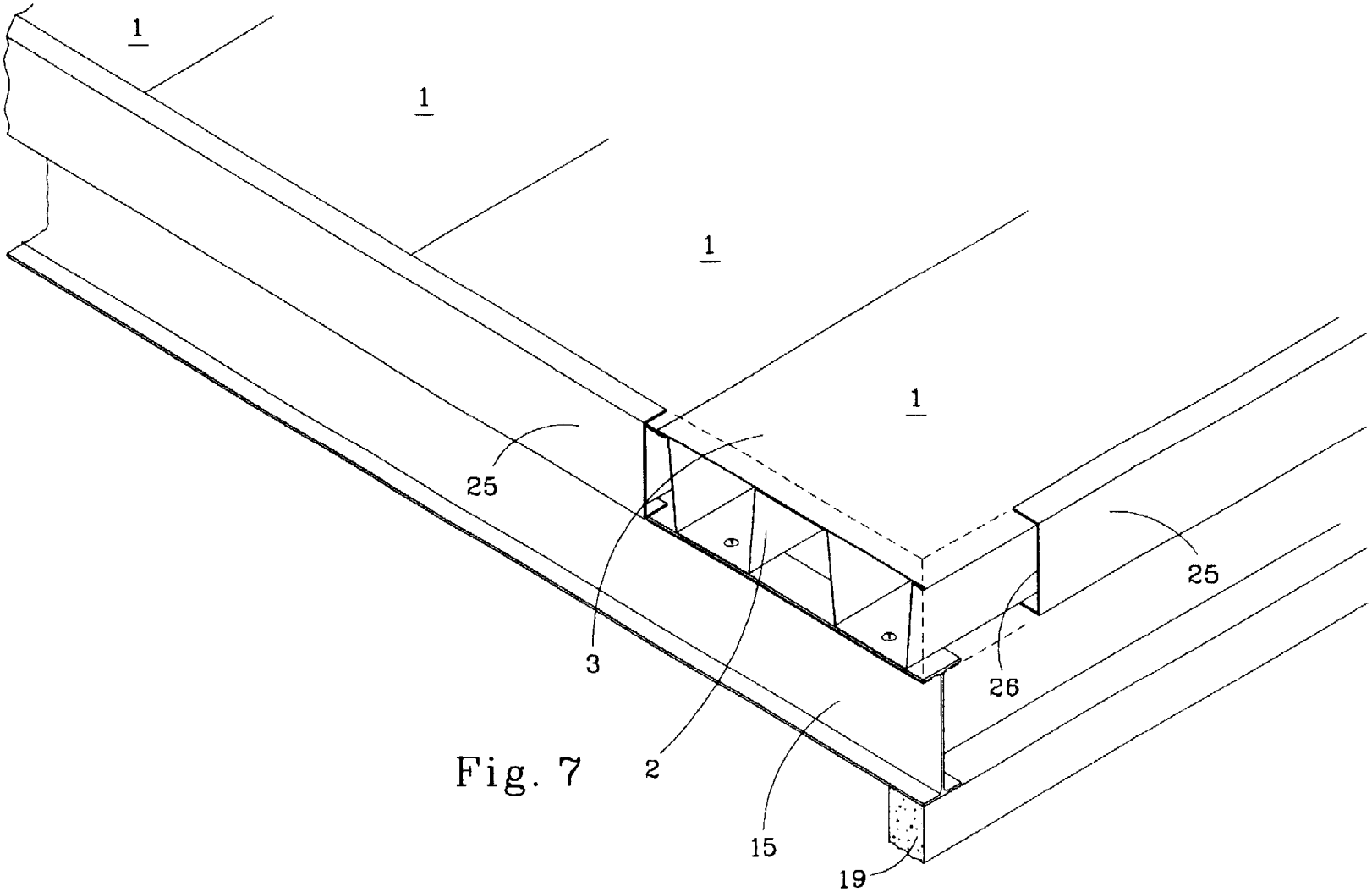
FIG. 7 is an isometric view showing the preferred metal planking having a facia trim installed.

Referring to FIGS. 6 and 7, after the metal planking 1 is assembled on the deck, floor or roof system, selected cellular channels 16 are filled with insulation 17 and utilities, not shown, are run through the cellular channels 16 that are left open. If desired, insulation 17 may be applied to these open cells after the utility connections are completed. Suitable facia trim 25 can be fastened along the perimeter of any of the above deck systems to improve their appearance. In FIG. 7 a metal channel section 26 is shown fastened to the metal planking to provide facia. However, any suitable facia shape, for example, a metal angle, may be used as an equivalent facia 25.

Although the preferred embodiment of the invention is directed to metal planking for patio deck construction as shown in FIGS. 8 and 9, the metal planks are also suitable for use on porches, balconies, and flat roofs as shown in FIG. 10, interior floors shown in FIG. 6, and pitched roofs as shown in FIGS. 11–14.

Referring to FIGS. 8 and 9, an elevated patio deck 27 is shown supported above grade level on columns 28. The patio deck 27 comprises a structural frame 29 having joists or beams 30 that extend from one end of the structural framework 29 to an opposite end of frame 29. The metal planking 1 comprising, struts 2 and caps 3 assembled as heretofore described, and the struts are fastened to the joists 30 of the frame.

A grade level patio deck 31 is shown in FIG. 9 comprising a structural frame and metal deck planking 1 trimmed with channel shaped facia 26. The structural frame, similar to the frame described above in the patio deck 27, is hidden from view by the facia trim 26. The patio deck framework may be placed directly upon prepared grade or on a foundation just slightly above grade level. The metal deck planking comprise struts 2 and caps 3 assembled as disclosed above.

FIG. 10 shows an equivalent deck system where the metal planking 1 of the invention is assembled at a multistory building job site, in the same manner as described above, to construct a porch 32, balconies 33 and 34 and a flat roof 35 and steps 37. The porch 32 is cantilevered outward from the front wall of the building structure 36 and comprises metal planking 1 supported by a structural framework 29 covered by metal facia 25 to finish off the perimeter of the porch. The structural framework and metal planks are assembled with struts 2 and slidable caps 3 as disclosed in the preferred embodiment. A stairway 37 extends from porch 32 to ground level to provide access onto the porch level, and a railing 38 extends along portions of the porch to provide safety.

The stairway includes two or more stringers 37*c*. Metal planks, assembled with struts and slidable caps as disclosed in the preferred embodiment, are attached to span the stringers 37*a* and provide risers 37*a* and treads 37*b* in the stairway.

A balcony 33, also extending outward from the building structure 36, is shown supported by columns 39. Balcony 33 comprises a structural framework 29, having joists 30 to support metal planking 1. The metal planking include struts 2 and slidable caps as described and assembled above, and balcony 33 includes a railing 38 to provide safety.

A second balcony 34 extending from the building structure is also supported on the columns 39. Balcony 34 is smaller than the first balcony 33. Balcony 34 comprises a structural framework 29, joists 30 metal planking 1 and a safety railing 38. The metal planking 1 is assembled as before using, struts 2 and slidable cap sections.

The building, structure shown in FIG. 10 also includes a flat roof. Typically, such flat roof construction includes alternating layers of roof felt, pitch and stone chips to provide a weather barrier. The support structure for such buildup roof construction normally includes a plurality of spaced apart wooden joists over which 4×8 sheets of plywood are laid to provide a base for the roofing material. In this case, however, support members 15, as described in FIG. 6 are spaced apart across the bearing, walls of the building structure 36, and metal planking 1 spans the support members to provide a base for the built-up roof materials. The metal planking 1 is assembled using struts 2 and slidable caps 3 as described in the preferred embodiment of the invention.

Figure 11:
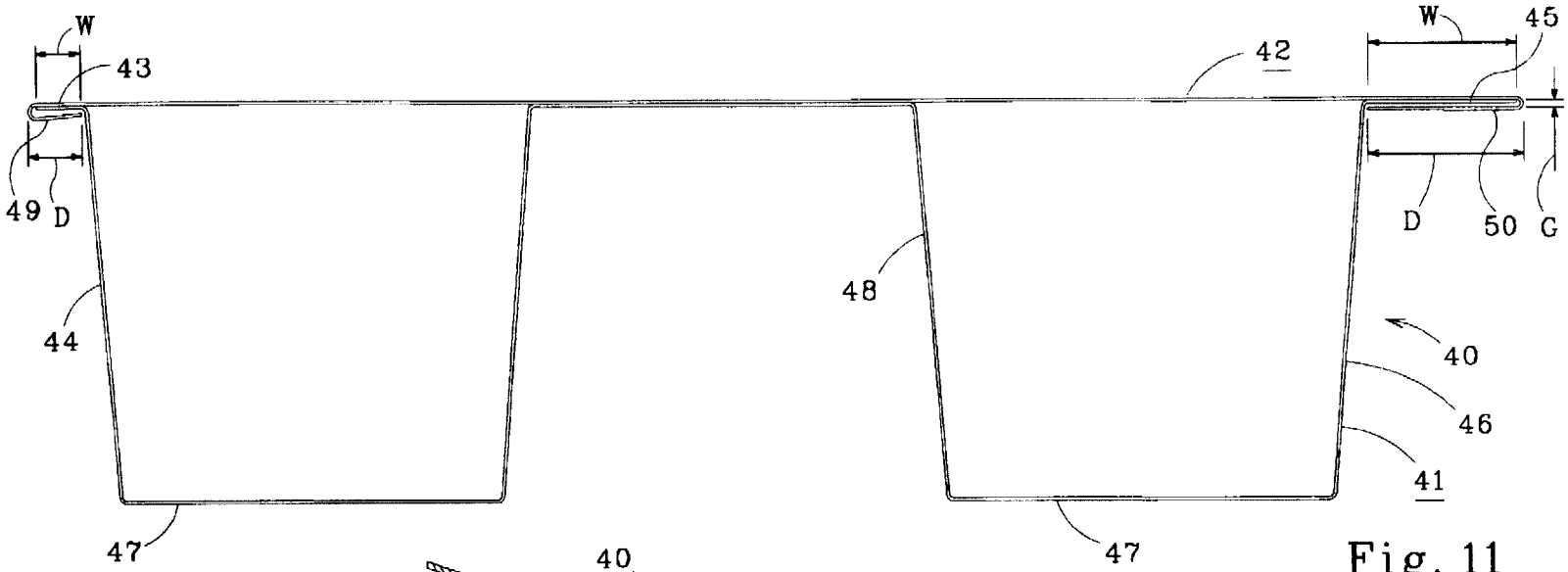
FIG. 11 is a fragmentary end view showing equivalent deck planking adapted for use in a pitched roof.
Figure 12:
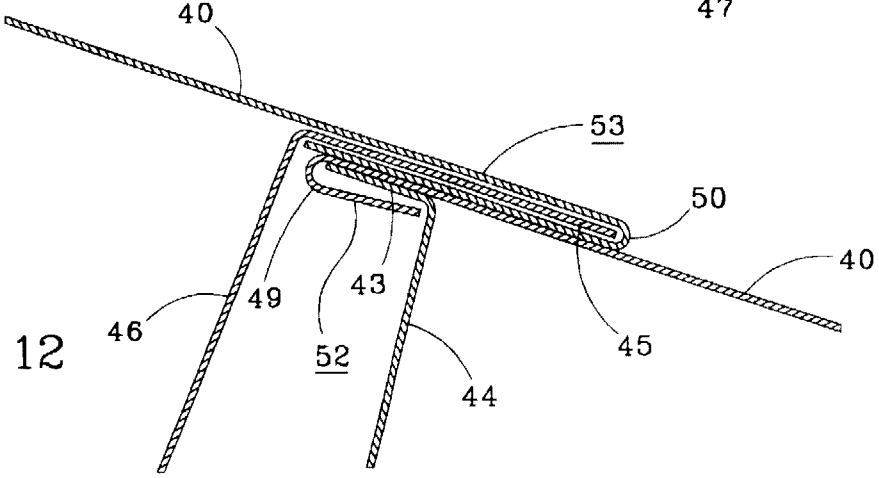
FIG. 12 is an enlarged view showing the overlapping sliding connection used to assemble metal planking in a pitched roof system.
Figures 13, 14, 15:
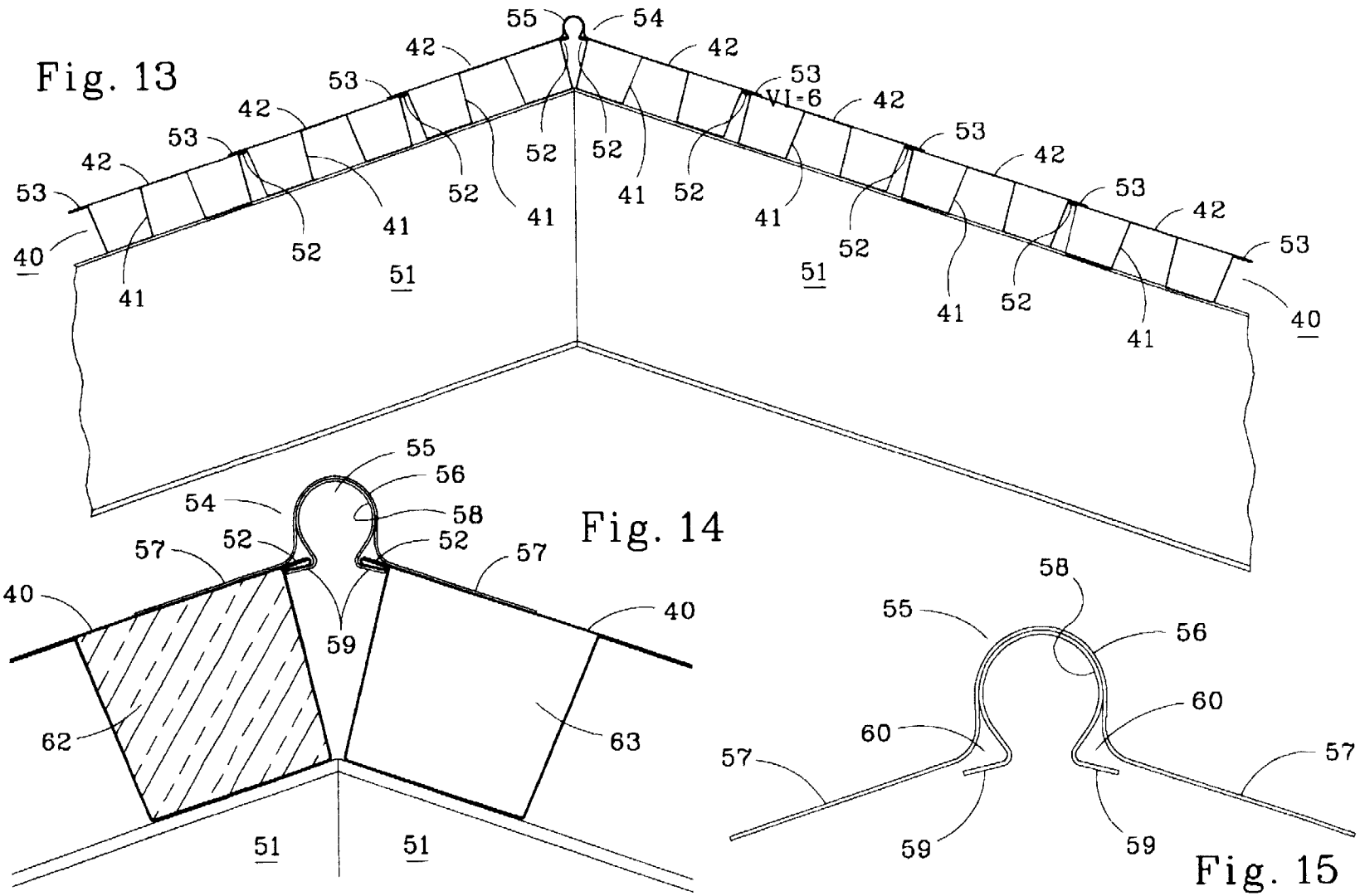
FIG. 13 is a view similar to FIG. 11 showing an enlarged portion of the roof purlin.
FIG. 14 is an enlarged view showing a cap for use with metal planking in a pitched roof system.
FIG. 15 is a view similar to FIGS. 13–14 which further describes the claimed invention.

Alternate metal planking 40, shown in FIGS. 11–13, is adapted for use in constructing a pitched roof in either residential or commercial buildings. The alternate metal planking is assembled at the construction site in a manner similar to the assembly method described in the preferred embodiment. Planking 40 comprises a strut 41 that is attached to the rafters 51 in a pitched roof prior to sliding cap 42 onto the strut to form the alternate metal planking 40.

As shown more clearly in FIG. 11, planking 40 comprises a strut 41 and a cap 42. Strut 41 includes a first flange 43 and first web 44 opposite a second flange 45 and second web 46, a cord 47 that extends between webs 44 and 46, and at least one cord corrugation 48 located between the first and second webs and extending in an upward direction from cord 47 to a position adjacent the plane of the first and second flanges 43 and 45. Cap 42 has a first teardrop shaped hem 49 that extends along one side of the cap 42, and a second teardrop shaped hem 50 that extends along, the opposite side of the cap. Both teardrop shaped hems include an opening shaped to receive one of the opposed flanges as described in the preferred embodiment, and each hem 49 and 50 provides an elongated hollow seam that slidably engages its corresponding flange. This provides a slidable connection between the hems and strut flanges so that a cap section 42 can be pushed onto one end of an uncapped strut that is fastened to a roof rafter 51, as shown in FIG. 13. Cap 42 is slipped along a length of the strut 41 to cover the strut and form the metal planking 40. In order to provide the necessary sliding fit between the cap 42 and the strut flanges, the hollow seam in hems 49 and 50 comprises a seam depth "D" that is greater than the width "W" of the flanges 43 and 45, and gap "G" that is greater than the thickness of the metal used to manufacture strut 41.

Referring in particular to FIG. 12, the second flange 45 of the alternate embodiment has a width "W" that is greater than the width "W" of the first flange 43, and the second hem 50 has a depth "D" that is greater than the depth "D" of the first hem 49. This arrangement provides means to overlap a fastened strut 41 with the second flange 45 of the next fastened strut 41 as the metal planking 40 is laid in shingle like fashion from the roof edge to the roof peak 54. As shown in FIGS. 13–15, the struts 41 are attached to rafters 51 in a shingle like fashion where the second flange 45 overlaps the preceding strut 41, and then covered with slidable caps 42 to form overlapping metal planks 40 from the drip edge of the roof (not shown), to the peak or ridge 54 of the roof, where a cap 55 is fastened to cover the last or topmost metal plank.

Cap 55 is slipped onto flange 52 of the uppermost metal plank that extend along the ridge line of the roof. Cap 55 includes an outer shaped flashing 56 having opposed elongated flanges 57 that overlap the metal plank 40 adjacent the roof ridge on opposite sides of the pitched roof, and an inner flashing 58 having opposed elongated flanges 59 that are distal from flanges 57 to provide a slot 60 shaped to receive the first metal plank flanges 52 when cap 55 is slipped onto the planks 40 that extend along the ridge line of the roof. This configuration provides a watertight lap 61 between cap 55 and planks 40 by overlapping the metal planks with the elongated flanges 57 as shown in FIG. 14. It should be understood that any cap configuration that provides a watertight lap may be provided without departing from the scope of this invention. Referring again to FIG. 14, after the metal planks 40 are assembled to form a shingle like roof, the cellular channels 63 can be either filled with an insulation material 62 or left open as shown at number 63, and facia, soffits and drip edges can be added to the roof to provide a finished appearance and provide weathertight seals along the edges of the roof.

While the preferred embodiment of this invention has been described as using metal for forming the planking, it should be understood that any suitable material, either natural or synthetic, may be used to form the struts and caps of the planking without departing from the scope of the invention. And, while this invention has been described as having a preferred design, it is understood that it is capable of further modifications, uses, and/or adaptations following in general the principle of the invention and including such departures from the present disclosure as come within known or customary practice in the art to which the invention pertains, and as may be applied to the essential features set forth herein, and fall within the scope of the invention limited by the appended claims.

We claim:

1. Metal planking comprising:

a) a plurality of struts fastened to support members of a structure, each strut including;

i) a first flange and first web, ii) a second flange and second web spaced apart from said first flange and first web, and iii) a cord extending between said first web and said second web, said cord providing a surface for fastening said strut to the support members, said plurality of struts being fastened to the support members at spaced positions whereby said second flange overlaps the first flange of an adjacent strut fastened to the support members; and b) a cap including;

i) a first hem extending along a first edge of said cap and shaped to receive the first flange of a strut, ii) a second hem extending along a second edge of said cap, opposite said first edge, and shaped to receive the second flange of said strut, so that when said cap is positioned on said strut, said second hem of said cap overlaps the first hem of a cap positioned on an adjacent strut fastened to the support members.

2. The metal planking recited in claim 1 wherein the structure is a building and said planar surface is a pitched roof.

3. A method of constructing a planar surface in a structure using metal planking, the steps of the method comprising:

a) spanning at least two support members of the structure with a plurality of struts, each strut comprising;
   i) a first flange and a first web,
   ii) a second flange and a second web spaced apart from said first flange and said first web, and
   iii) a cord having at least one corrugation and extending between said first web and said second web;

c) fastening said cord of each strut in said plurality of struts to the at least two support members;

d) pushing a slidable cap onto said first flange and said second flange of each said strut, each said slidable cap having a first hem extending along a first edge and a second hem extending along a second edge opposite said first edge, said first hem and said second hem each having a seam shaped to slidably receive either said first flange or said second flange of each said strut; and e) sliding said slidable cap along said first flange and said second flange of each said strut to cover a length of each said strut after said cord is fastened to the at least two support members.

4. The method according to claim 3 wherein said plurality of struts having said cords fastened to the at least two support members of the structure are spaced apart to provide a gap between and along the length of adjacent metal planks formed after said slidable caps are pushed along a length of said first and second flanges of each said strut.

5. The method according to claim 3 comprising the further step of:

a) applying an insulation material to cellular channels formed by said at least one corrugation and said slidable cap pushed onto said strut.

6. The method according to claim 3 comprising the further step of:

a) fastening a facia trim along an edge of said planar surface constructed using said metal planking.

7. The method according to claim 6 wherein said facia trim is fastened to the perimeter of said planar surface constructed using said metal planking.

8. The metal planking recited in claim 3 wherein said cord is fastened to at least two support members in a patio to construct a patio deck.

9. The metal planking recited in claim 3 wherein said cord is fastened to at least two support members in a porch to construct a porch deck.

10. The metal planking recited in claim 3 wherein said cord is fastened to at least two support members in a balcony to construct a balcony deck.

11. The metal planking recited in claim 3 wherein said cord is fastened to at least two support members in a building to construct an interior floor.

12. The metal planking recited in claim 3 wherein said cord is fastened to at least two support members in a building to construct a flat roof.

13. The metal planking recited in claim 3 wherein said cord is fastened to at least two stringers in a stairway to provide a tread.

14. The metal planking recited in claim 3 wherein said cord is fastened to at least two stringers in a stairway to provide a riser.

15. A method of constructing a pitched roof using metal planking, the steps of the method comprising:

a) providing a plurality of struts each strut comprising,
   i) a first flange and a first web, said first flange having a width "W",
   ii) a second flange and a second web spaced apart from said first flange and said first web, said second flange having a width "W" greater than width "W" of said first flange, and
   iii) a cord extending between said first web and said second web, said cord having at least one corrugation;

b) providing a plurality of slidable caps each slidable cap comprising,
   i) a first hem having a seam shaped to slidably receive said first flange of a strut, and
   ii) a second hem having opposite said first hem and having a seam shaped to slidably receive said second flange of said strut;

c) fastening a plurality of struts to support members in the pitched roof, the steps comprising,
   i) fastening a strut to a support member to provide a fastened strut along a length of the pitched roof;
   ii) fastening a next strut to the support members adjacent said fastened strut, said next strut being positioned to cause its said second flange to extend over and above said fastened strut,
   iii) repeating step (ii) until a last strut in said plurality of struts is fastened to the support members of the pitched roof, and
   iv) pushing a slidable cap onto said first flange and said second flange of each said strut fastened to the support members and sliding each said slidable cap along said first flange and said second flange to cover a length thereof and thereby forming said metal planking.

16. The method of constructing a pitched roof according to claim 15 wherein the step pushing a slidable cap to form said metal planking proceeds the step fastening said next strut to the support members adjacent said fastened strut.

17. The method of constructing a pitched roof according to claim 15 comprising the further step:

a) fastening a ridge cap to cover said metal planking formed by pushing said slidable cap onto said last strut.

18. The method according to claim 15 comprising the further step of:

a) applying an insulation material to cellular channels formed by said at least one corrugation and said slidable cap.

* * * * *